US006805260B2

(12) United States Patent
Wadlinger

(10) Patent No.: US 6,805,260 B2
(45) Date of Patent: Oct. 19, 2004

(54) DEVICE AND METHOD FOR FEEDING SHEETS TO A SHEET-PROCESSING MACHINE, ESPECIALLY A PRINTING PRESS

(75) Inventor: Ralf Wadlinger, Hockenheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 28 days.

(21) Appl. No.: 10/271,283

(22) Filed: Oct. 15, 2002

(65) Prior Publication Data

US 2003/0071411 A1 Apr. 17, 2003

(30) Foreign Application Priority Data

Oct. 15, 2001 (DE) ..... 101 50 848

(51) Int. Cl.[7] ..... B65H 9/04; B65H 5/02; B51F 21/00

(52) U.S. Cl. ..... 221/237; 221/243; 221/245

(58) Field of Search ..... 271/237, 243, 271/245

(56) References Cited

U.S. PATENT DOCUMENTS 4,428,667 A * 1/1984 Phelps et al. ..... 399/372
5,147,092 A * 9/1992 Driscoll et al. ..... 271/184
5,385,342 A * 1/1995 Leib ..... 271/274
5,829,741 A * 11/1998 Dopke et al. ..... 271/245
5,975,524 A * 11/1999 Dopke et al. ..... 271/245
2001/0004144 A1 * 6/2001 Faster et al. ..... 271/226

FOREIGN PATENT DOCUMENTS

DE 2552277 * 11/1975 ..... B65H/3/00
DE 42 13 017 C2 10/1993
DE 29615996 U1 * 9/1996 ..... B41F/21/04
DE 296 15 996 U1 12/1996
DE 199 33 064 A1 1/2001
DE 199 62 116 A1 6/2001

* cited by examiner

*Primary Examiner*—Donald D. P. Walsh
*Assistant Examiner*—Kenneth W Bower
(74) *Attorney, Agent, or Firm*—Laurence A. Greenburg; Werner H. Stemer; Gregory L. Mayback

(57) ABSTRACT

A device for feeding sheets to a sheet-processing machine includes a feeding table. Front lays are disposed at a front end of the feeding table, as viewed in a sheet-conveying direction. A first guide device is disposed immediately upstream from the front lays, as viewed in the sheet-conveying direction, and above the feeding table, and is adjustable vertically with respect to the feeding table. A second guide device is disposed upstream from the vertically adjustable first guide device, as viewed in the sheet-conveying direction. The second guide device is disposed in a position oriented parallel to the first guide device. A method of operating the sheet-feeding device is also provided.

11 Claims, 8 Drawing Sheets

DEVICE AND METHOD FOR FEEDING SHEETS TO A SHEET-PROCESSING MACHINE, ESPECIALLY A PRINTING PRESS

BACKGROUND OF THE INVENTION

Field of the Invention

The invention relates to a device and a method for feeding sheets to a sheet-processing machine, such as a printing press especially.

A device of the foregoing type has been disclosed by German Petty Patent DE 296 15 996 U1. A guide roller is described therein, which serves as a guide device for holding down sheets to be processed. The guide roller is mounted so as to be adjustable vertically, for the purpose of adapting it to the respective paper thickness. In addition, the guide roller is adjustable with regard to the spacing thereof from front lays, the selected spaced distance from the front lays being increased in order to process sheets of thick paper and Cardboard or pasteboard, respectively, because of the comparatively low flexibility of materials of this type.

The great distance of the guide roller from the front lays, which therefore in principle signifies an advantage in the processing of (board) sheets, because the (comparatively inflexible) sheets may easily be fed over the front and top lays and to the relevant feeder drum in this way, has a disadvantageous effect with regard to a first sheet, in that the first sheet cannot be guided adequately securely under the top lays as the first sheet is brought up to the front lays. It is possible for so-called overshoots to occur here.

A further disadvantage of the heretofore known guide device according to the aforementioned German Petty Patent DE 296 15 996 U1 is that the guide device is fixed to the frame on the feed table and makes accessibility to the front/top lay and to a pregripper more difficult. In addition, clearing the feed table, as is required when so-called stoppers occur, is thereby hampered.

SUMMARY OF THE INVENTION

It is accordingly an object of the invention to provide a device and a method for feeding sheets to a sheet-processing machine, especially a printing press, which overcome the hereinafore-mentioned disadvantages of the heretofore-known devices and methods of this general type and in which a guide device is configured in such a way that secure and marking-free sheet feeding without any "overshoots" is assured, and indeed, especially in the case of sheets of thick paper and board as well. In addition, when the front lay guard is opened, no disruptive superstructures should make accessibility to the feed table and to the front/top lay more difficult.

With the foregoing and other objects in view, there is provided, in accordance with the invention, a device for feeding sheets to a sheet-processing machine, particularly a printing machine, comprising a feeding table. Front lays are disposed at a front end of the feeding table, as viewed in a sheet-conveying direction. A first guide device is disposed immediately upstream from the front lays, as viewed in the sheet-conveying direction, and above the feeding table, and is adjustable vertically with respect to the feeding table. A second guide device is disposed upstream from the vertically adjustable first guide device, as viewed in the sheet-conveying direction. The second guide device is disposed in a position oriented parallel to the first guide device.

In accordance with another feature of the invention, the sheet-feeding device further comprises an upwardly pivotable-away front lay guard. The first guide device is disposed on the front lay guard so as to be pivotable about an axis oriented transversely with respect to the sheet-conveying direction.

In accordance with a further feature of the invention, the pivot axis of the first guide device is disposed in such a way that as a distance of the first guide device to the feeding table increases, a distance of the first guide device to the front lays simultaneously becomes greater.

In accordance with an added feature of the invention, the sheet-feeding device further comprises a pneumatic cylinder disposed on the front lay guard. The pneumatic cylinder serves for vertically adjusting the first guide device.

In accordance with an additional feature of the invention, the sheet-feeding device further comprises a separating-shoe profile pivotably disposed on the front lay guard. The first guide device has a plurality of guide rollers oriented coaxially with one another in a row and mounted on the separating-shoe profile.

In accordance with yet another feature of the invention, the second guide device, in comparison with the first guide device, has at most only a few guide rollers disposed at comparatively large axial distances from one another.

In accordance with yet a further feature of the invention, the second guide device is also disposed, at least partly, on the front lay guard.

In accordance with yet an added feature of the invention, the sheet-feeding device further comprises a pulling device for lateral sheet alignment. The second guide device is connected, at least partly, to the pulling device.

In accordance with yet an additional feature of the invention, the second guide device includes a central guide roller and two lateral guide rollers. The central guide roller is assigned to the front lay guard, and the two lateral guide rollers are respectively assigned to the pulling device.

With the objects of the invention in view, there is also provided a method of feeding sheets, which comprises providing a sheet-feeding device having a first guide device. The first guide device is positioned into an operating position close to a surface of a feeding table for processing a first sheet. The first guide device is adjusted into a stop position at a greater distance from the feeding table for processing further sheets following the first sheet.

In accordance with another mode of the invention, the method further comprises providing sheets of thick paper and board to be respectively fed, having a thickness of at least approximately 0.3 mm to at least approximately 0.6 mm.

With the objects of the invention in view, there is additionally provided a method of feeding sheets, which comprises providing a device for feeding sheets to a sheet-processing machine, including a feeding table. Front lays are disposed at a front end of the feeding table, as viewed in a sheet-conveying direction. A first guide device is disposed immediately upstream from the front lays, as viewed in the sheet-conveying direction, and above the feeding table, and are adjustable vertically with respect to the feeding table. A second guide device is disposed upstream from the vertically adjustable first guide device, as viewed in the sheet-conveying direction. The second guide device is disposed in a position oriented parallel to the first guide device. The first guide device is positioned into an operating position close to a surface of the feeding table for processing a first sheet. The first guide device is adjusted into a stop position at a greater distance from the surface of the feeding table for processing further sheets following the first sheet.

According to the invention, therefore, the first guide device (close to the front lay) in the (lowered) operating position thereof, apart from the "normal case" of processing sheets of thin paper, serves and is required, respectively, for the first sheet only, when processing sheets of thick paper or board, i.e., cardboard or pasteboard, (in order to prevent "overshoots"). For succeeding sheets of thick paper or board, on the other hand, the guide function is performed only by the second guide device according to the invention, which is disposed farther away from the front lays, while the first guide device is here located in the (raised) stop position. Accordingly, the comparatively low flexibility of sheets of thick paper or board is taken optimally into account.

Other features which are considered as characteristic for the invention are set forth in the appended claims.

Although the invention is illustrated and described herein as embodied in a device and a method for feeding sheets to a sheet-processing machine, especially a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 7:
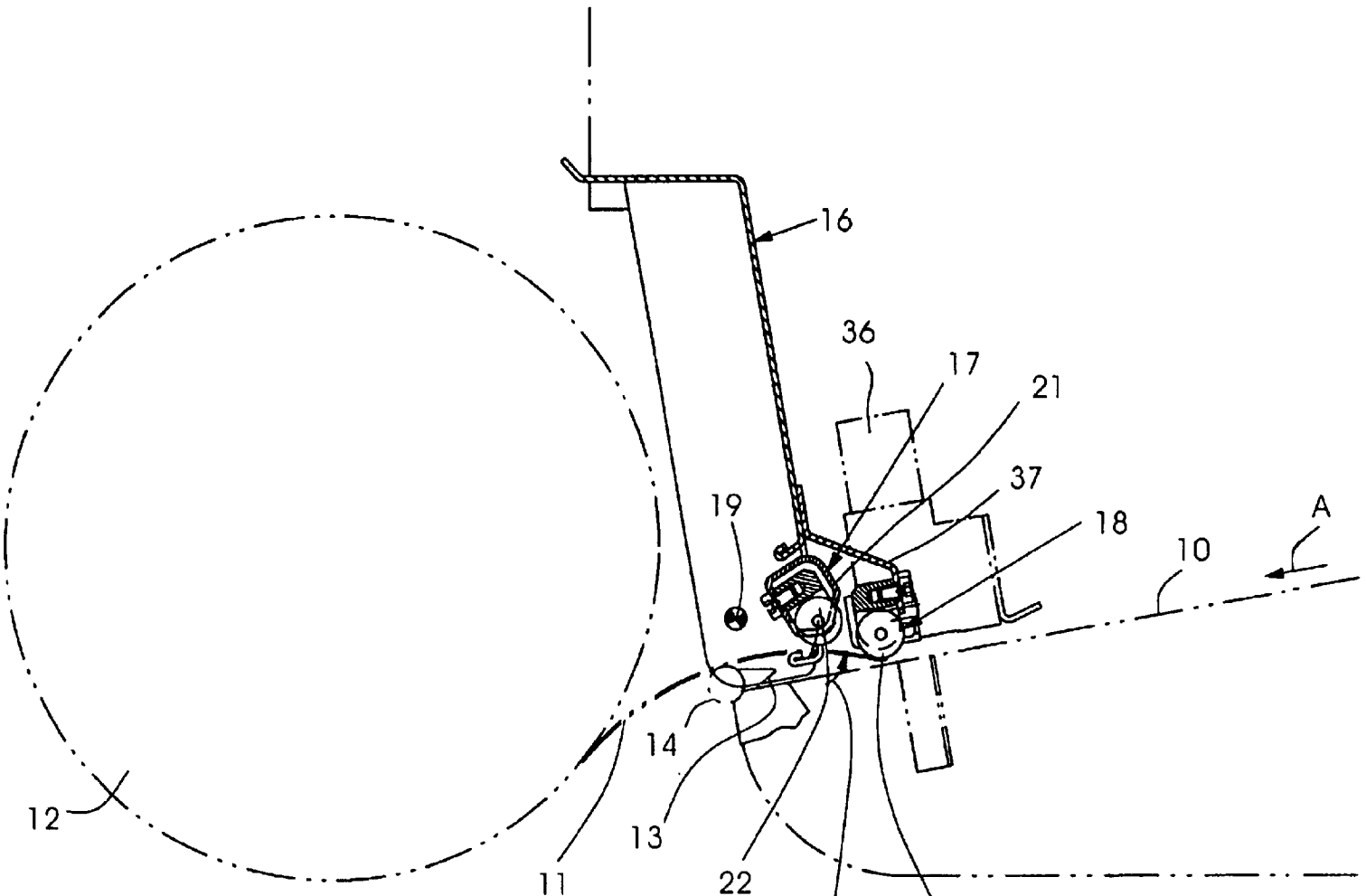
FIG. 7 is a slightly reduced fragmentary view of FIG. 3, in the operating position of the guide device thereof.

Referring now to the drawings and, first, particularly to FIG. 7 thereof, there is shown therein a feeding or feeder table for feeding sheets 11 to a printing press, of which only a feed cylinder 12 is illustrated. The sheets 11, for example, transported on the feeding table 10 in the direction of the arrow A, for example, in shingled or overlapped formation, initially come into contact with a front lay 13 before they are fed, as indicated in FIG. 7, to the feed cylinder 12 over a guide roller 14 for the purpose of further processing. The direction of rotation of the feed cylinder 12 is indicated by an arrow 15 (note FIG. 1, for example).

Figure 8:
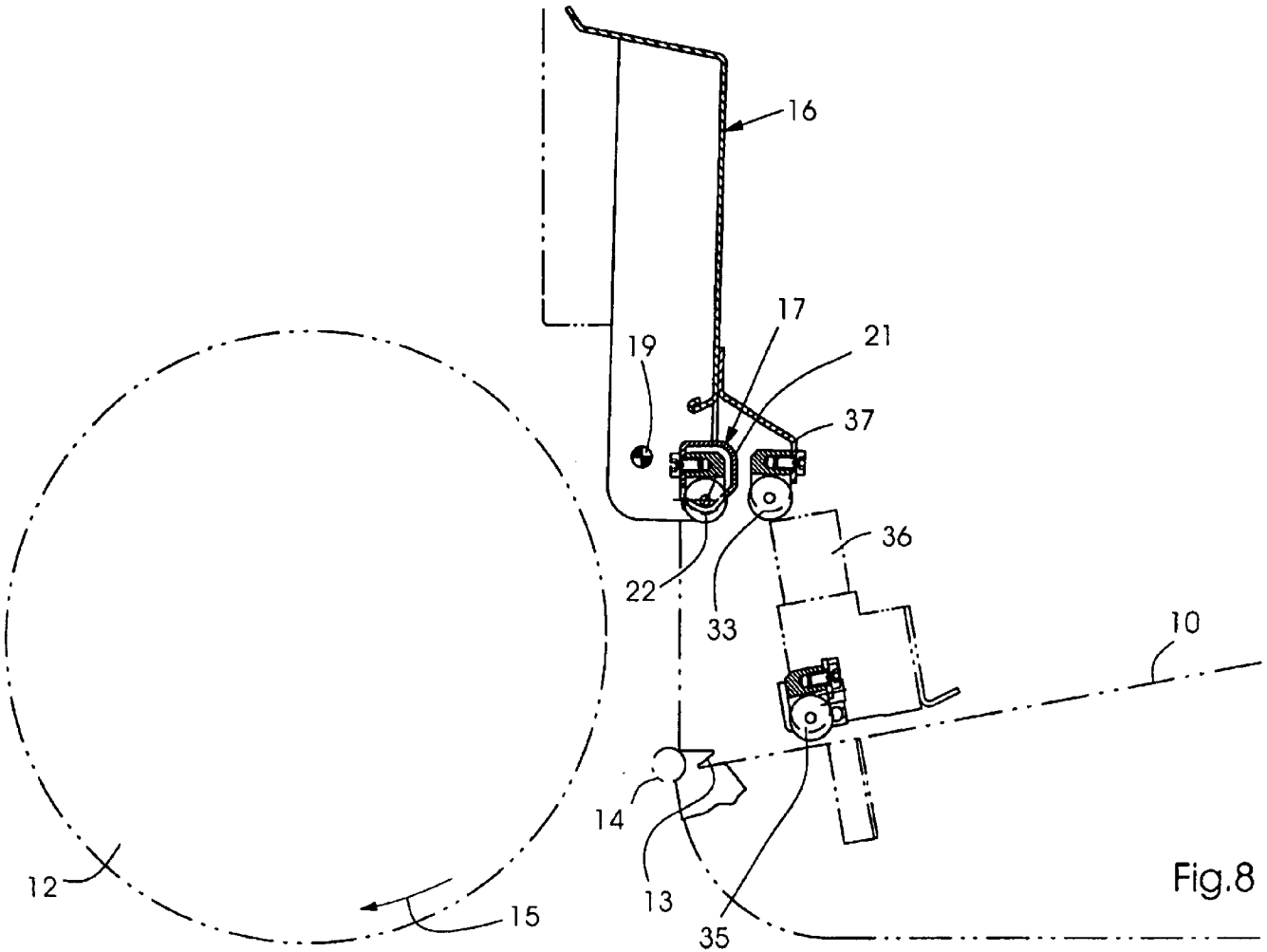
FIG. 8 is a view similar to those of FIGS. 6 and 7, with the front lay guard in an open position.

A front lay guard overall identified by reference numeral 16 is shown in FIGS. 1 to 7 in a (lowered) closed position, and in FIG. 8 in a (raised) open position. The front lay guard 16 simultaneously functions as a loadbearing frame for a first guide device 17 and (to some extent) also for a second guide device 18. The first guide device 17 is linked or attached to the front lay guard 16 so that the first guide device 17 is pivotable about an axis of rotation 19 within a range defined by stops, so that as the upward pivoting movement progresses in the direction of the arrow 20 (note FIGS. 5 to 7), the distance of the first guide device 17 from the front lays 13 simultaneously increases in a corresponding manner.

Figure 1:
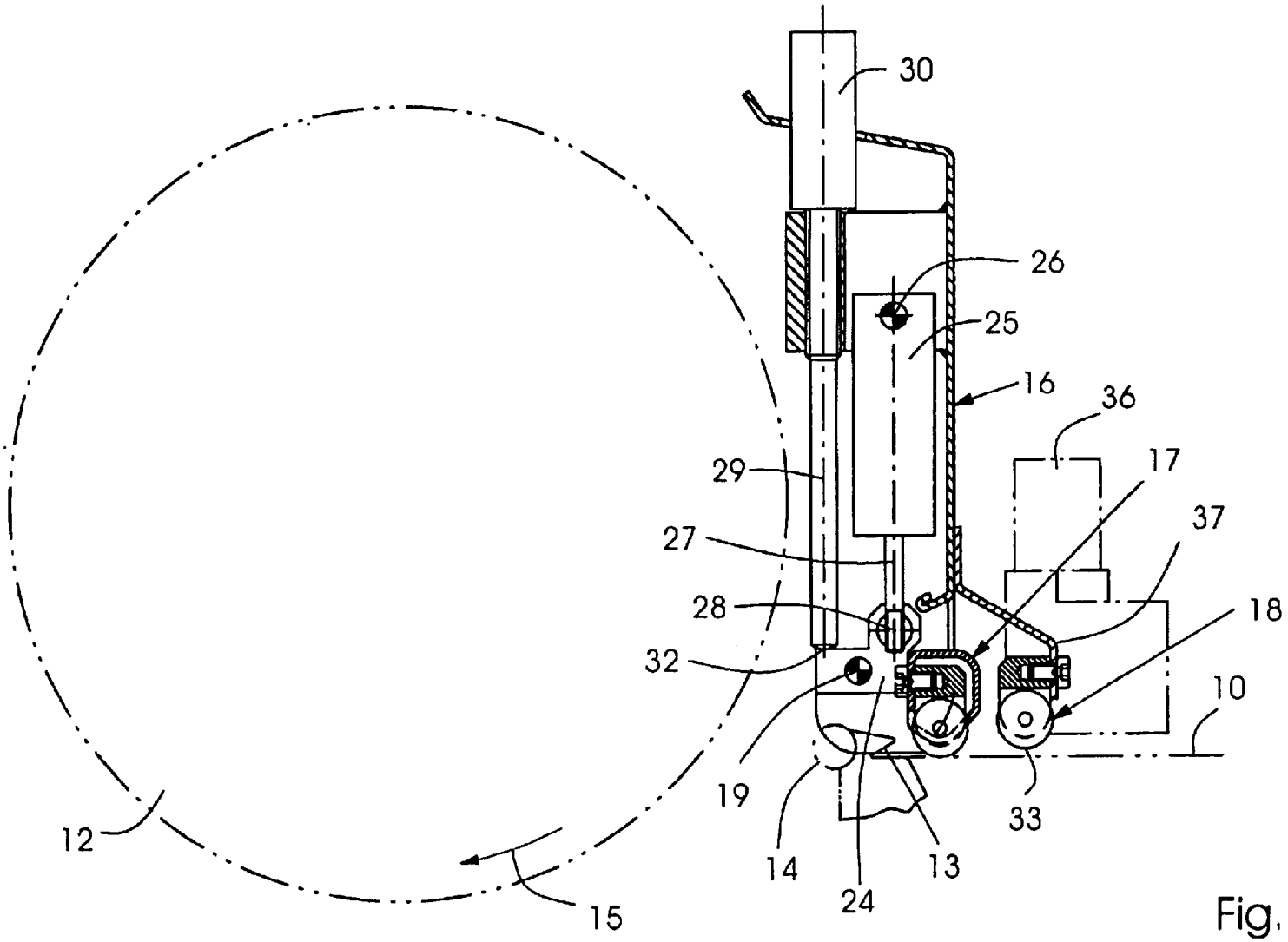
FIG. 1 is a diagrammatic, side-elevational view, partly in section, of an embodiment of the device according to the invention for feeding sheets to a printing press, the feeding device having a guide device in an operating position thereof for processing thin paper.
Figure 2:
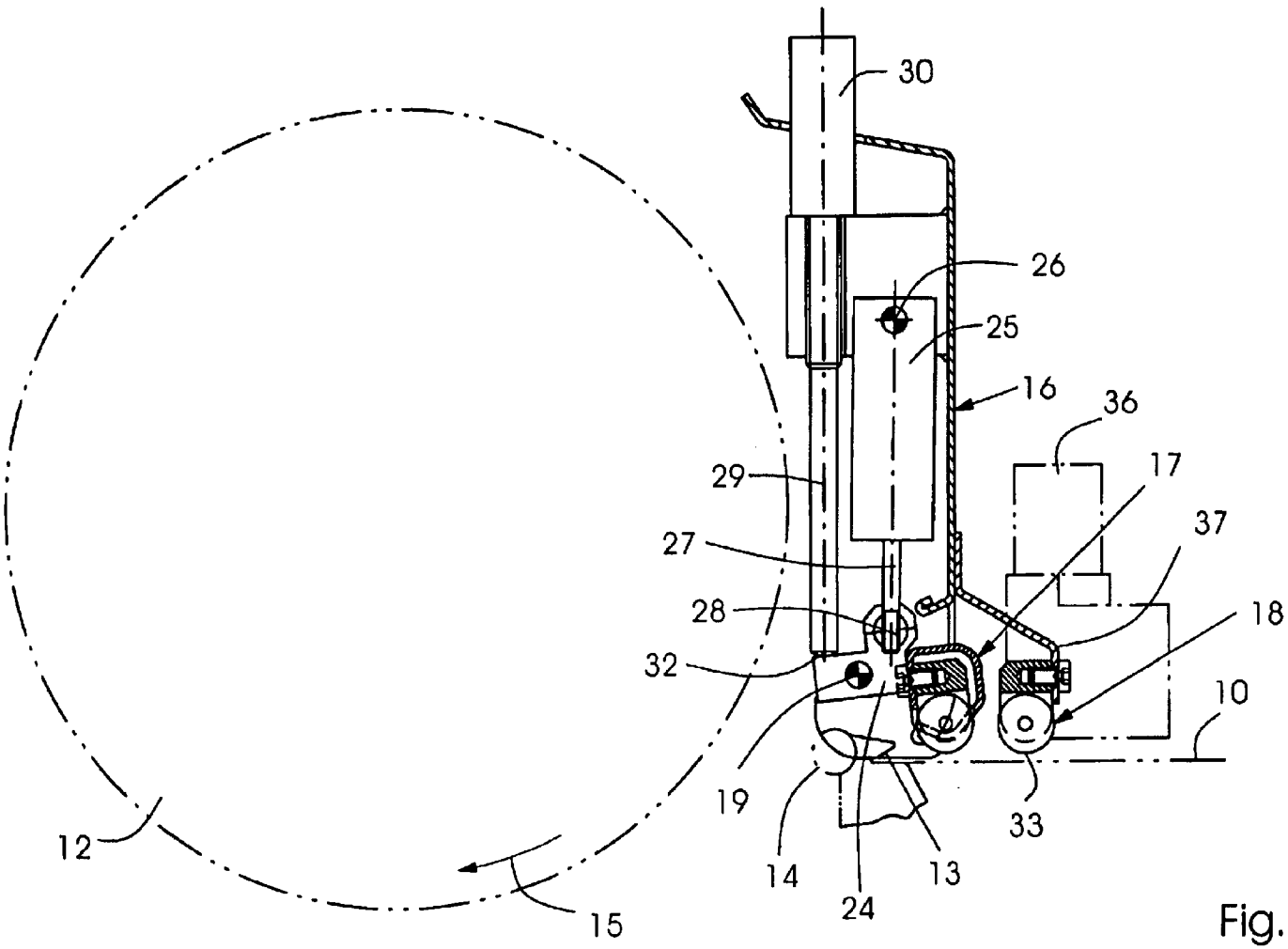
FIG. 2 is a view similar to that of FIG. 1 wherein the guide device of the feeding device is in an operating position thereof for processing thick paper and cardboard or pasteboard, respectively,(only for the first sheet)
Figure 3:
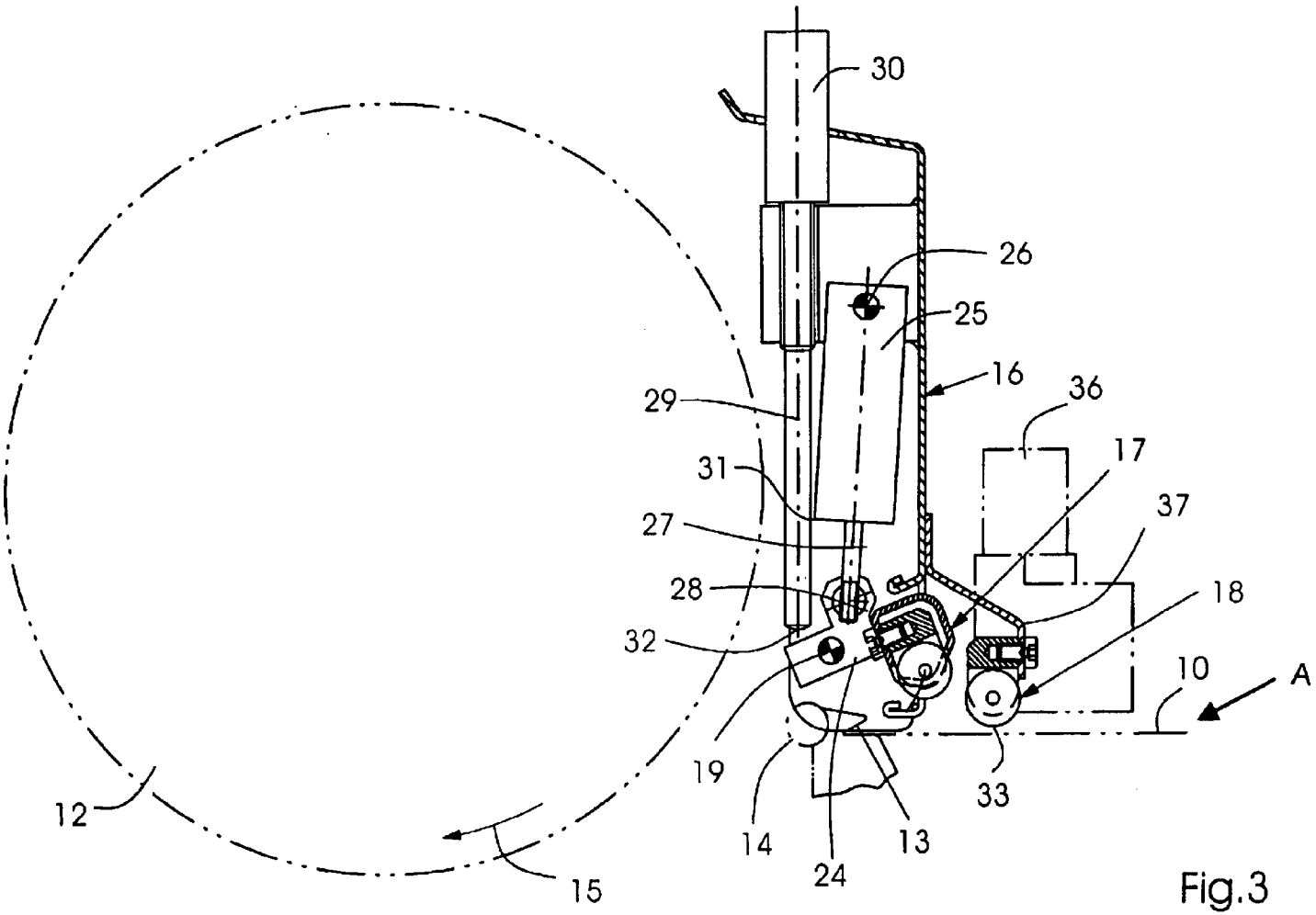
FIG. 3 is a view like that of FIG. 2, with the guide device in the operating position thereof for processing thick paper and cardboard or pasteboard, respectively, (only for the second and further sheets)

It is believed to be apparent in particular from FIGS. 1 to 3 that the first guide device 17 is attached to the front lay guard 16 by lateral loadbearing arms 24. For actuating, i.e., pivoting, the first guide device 17 about the pivot axis 19, a pneumatic cylinder 25 is provided, the pneumatic cylinder 25 being attached to the front lay guard 16 at 26 within the contours of the guard 16. An actuating piston 27 of the pneumatic cylinder 25 acts in an articulated manner at 28 on the relevant loadbearing arm 24 of the first guide device 17.

The two hereinaforementioned stops for the adjustment movement of the first guide device 17 are realized by a stop bolt 29, which can be adjusted by a stop screw 30. In the operating position according to FIG. 1 (and FIG. 5, respectively), the loadbearing arm 24 is in contact with an end 32 of the stop bolt 29. Further adjustment of the first guide device 17 in the direction towards the feed table 10 is therefore not possible. The other extreme position of the first guide device 17 is illustrated by FIG. 3 (and FIG. 7, respectively). Here, the pneumatic cylinder 25 comes into contact with the stop bolt 29 at 31 in FIG. 3, so that the first guide device 17 cannot be pivoted farther upwardly.

Figure 4:
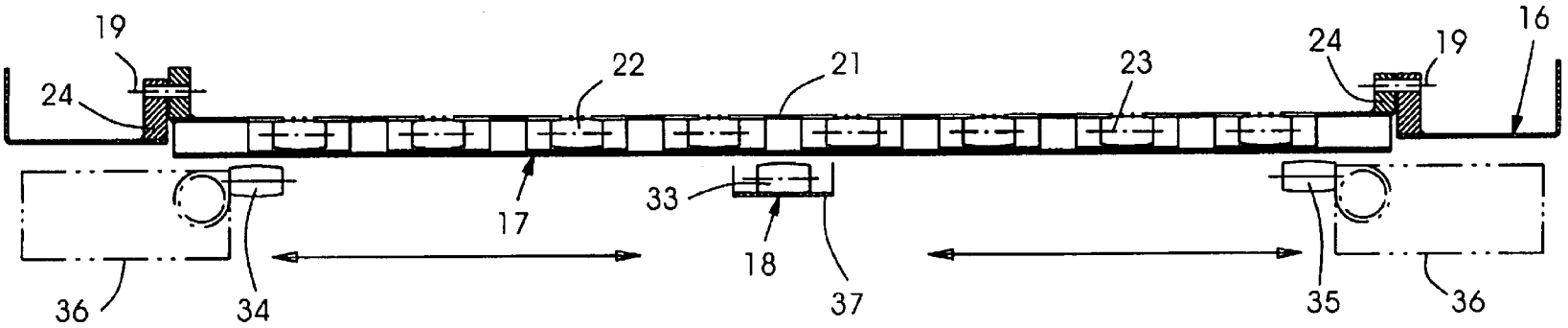
FIG. 4 is a top-plan view, in reduced size, of the guide device of FIG. 3 in the operating position thereof shown in FIG. 3, as seen in the direction of the arrow A, with the front lay guard omitted.

As evident in detail particularly from FIG. 4, the first guide device 17 includes a separating-shoe profile 21 extending over the entire sheet width. The profile 21 is mounted at 19 on the front lay guard 16 and is formed with recesses at uniformly spaced intervals, wherein small guide rollers 22, respectively, are rotatably mounted. The numerous small guide rollers 22 are oriented in alignment with one another in the direction of a common axis of rotation 23 thereof. The complete separating-shoe profile 21 may be set on and off, preferably pneumatically, as described hereinabove, so as to pivot about the pivot 19 between the two stops 31 and 32 of the stop bolt 29, the stop 29, 32 being adjustable in the set-on direction.

The significance of the adjustment in the set-on direction is that the small separating-shoe rollers 22 are adjusted to an optimal distance from the feeding table 10, depending upon the paper thickness. The optimal distance from the feeding table 10 is approximately three times the sheet thickness. The front lay guard 16 with the small separating-shoe roller profile 21 is thereby located in a position close to the front/top lays.

The construction of the second guard device 18 disposed upstream of the first guide device 17, as viewed in the conveying direction A (FIG. 7, for example), i.e., at a greater distance from the front lays 13, can likewise be seen in detail in FIG. 4. According to FIG. 4, the second guide device 18 has a total of only three small separating-shoe rollers 33, 34 and 35, which are disposed so as to be aligned with one another at relatively large spaced intervals. One special feature here is that the two outer small separating-shoe rollers 34 and 35 are associated with or assigned to a pulling device 36, shown in phantom, while the central small separating-shoe roller 33 is mounted on a separating-shoe profile 37, which is connected to the front lay guard 16 and can therefore be moved together with the front lay guard 16 into the opening position of the latter, i.e., upwardly (note FIG. 8). The second guide device 18 having the small separating-shoe rollers 33 to 35 becomes effective, in particular, when sheets with a high paper thickness (e.g. cardboard or pasteboard) are processed. For this special purpose, the small separating-shoe rollers 33 to 35 are disposed at an optimum distance from the feeding table 10. For rigid fixing or fastening, the small separating-shoe rollers 33 to 35, which correspond to those mentioned hereinabove in relation to the first guide device 17, must be mounted at a spaced distance from the feeding table 10, which is approximately three times the sheet thickness.

Although it would be conceivable to configure this distance to be adjustable vertically, in a manner similar to the first guide device 17, this would entail an increase in the changeover time.

The advantage of the multiplicity and plurality, respectively, of small separating-shoe rollers 22 and 33 to 35 employed, in particular, in the first guide device 17, but also in the second guide device 18 is that these rollers are small, have a correspondingly low mass and therefore can be mounted rotatably in a relatively simple manner. (When lower requirements are made on the freedom from marking of the sheets, sliding plates or a continuous sliding profile in the front lay guard 16 could also be imagined.)

For the case wherein very great demands are to be placed on freedom from smearing, it would be conceivable to configure the small separating-shoe rollers 22 and 33 to 35 so that they could also be set-off individually, for example if, during a second printing pass, individual areas on the relevant sheet are particularly susceptible to smearing.

Figure 5:
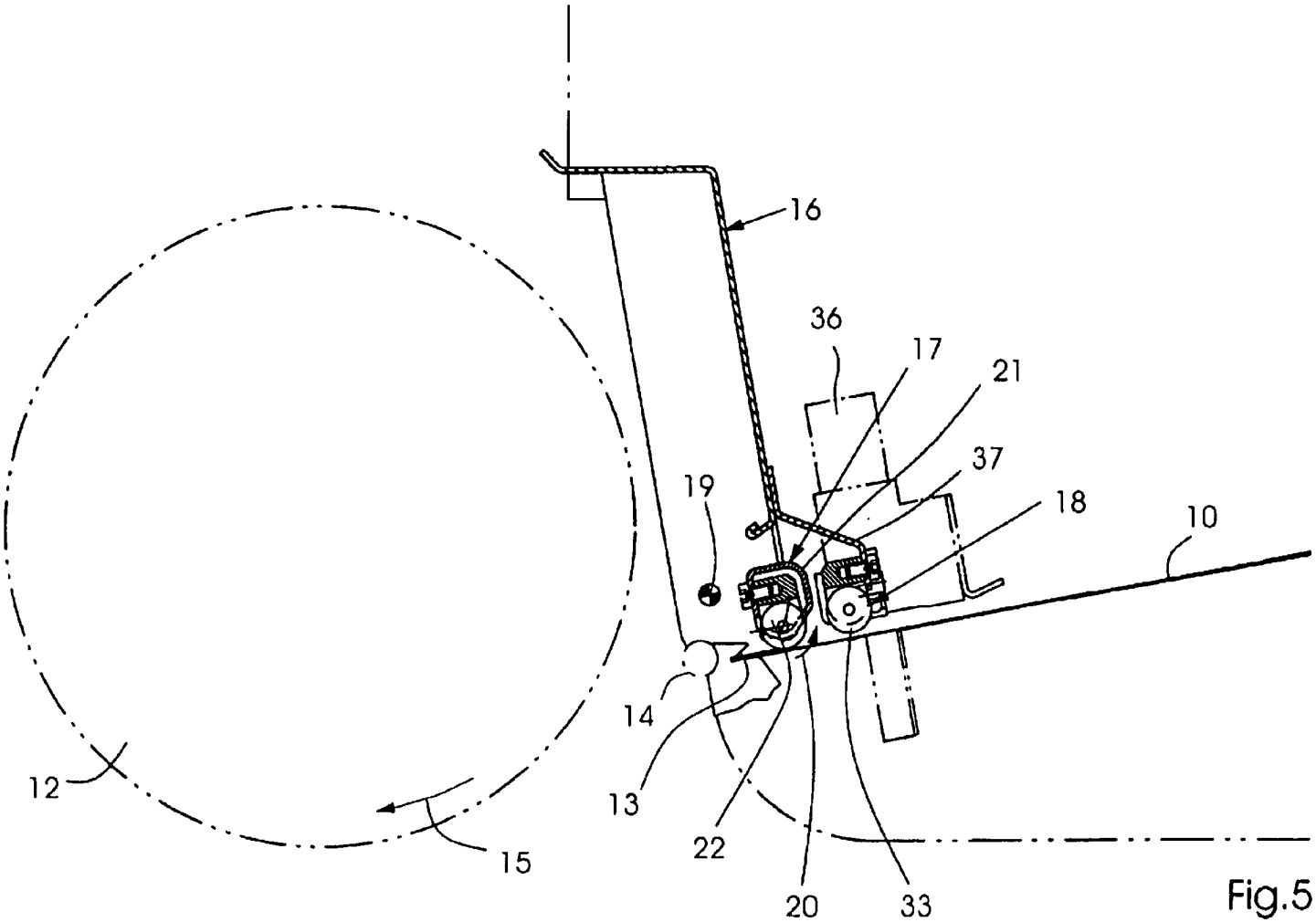
FIG. 5 is a slightly reduced fragmentary view of FIG. 1, in the operating position of the guide device thereof.
Figure 6:
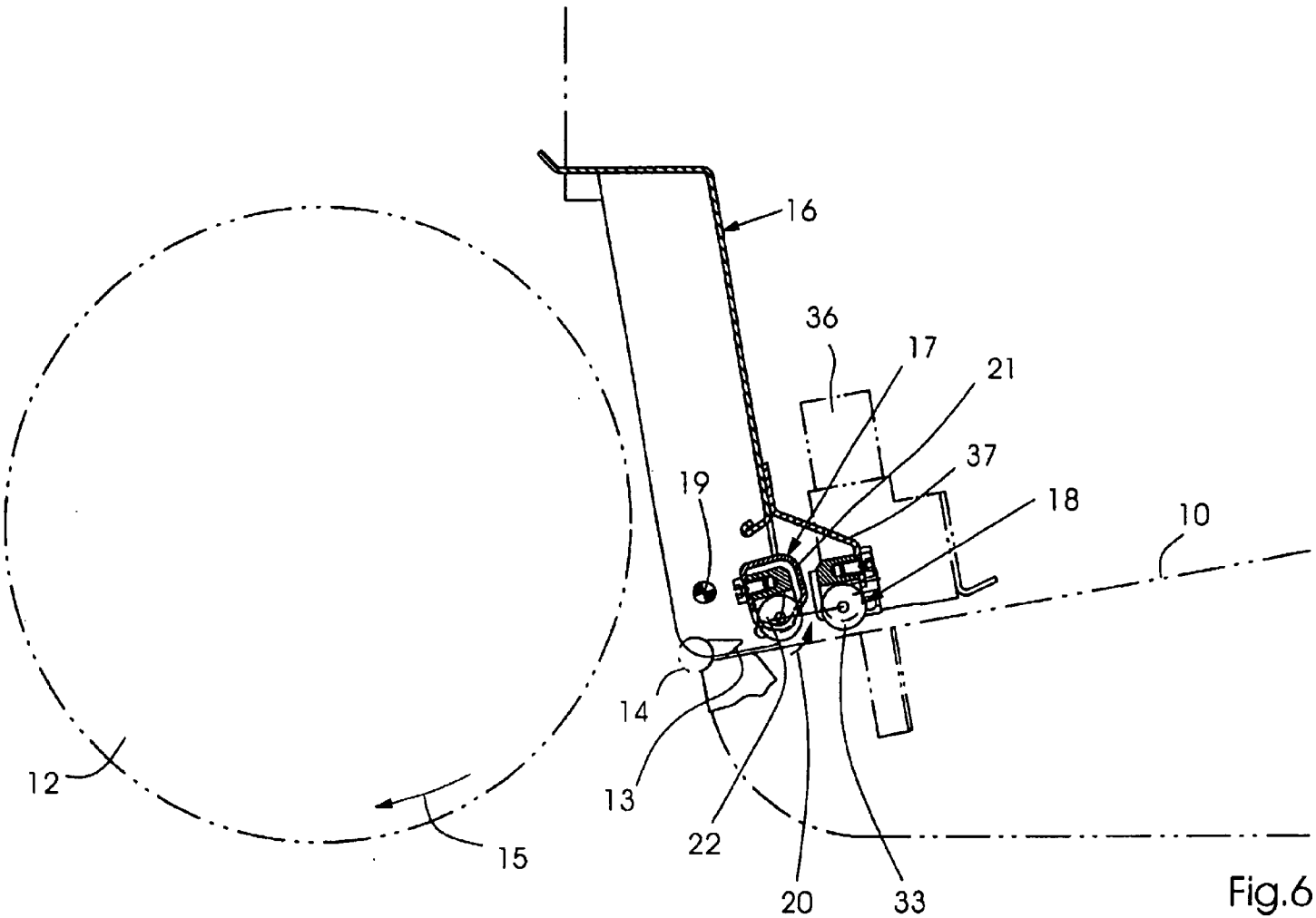
FIG. 6 is a slightly reduced fragmentary view of FIG. 2, in the operating position of the guide device thereof.

The device which can be seen from the drawing and has been described hereinabove, depending upon the respective paper thickness of the sheets to be processed, operates as follows (in this context, note particularly FIGS. 5 to 7). The setting of the first guide device 17 according to FIG. 5 (minimum distance of the small separating-shoe rollers 22 from the feed table 10) is provided for processing sheets of thin paper (sheet thickness 0.03 to 0.3 mm). The setting of the first guide device 17 which can be seen in FIG. 6 (wherein a very great distance of the small separating-shoe rollers 22 from the feeding table 10 is selected) serves for processing thick paper (thickness 0.3 to 0.6 mm), but only for the first sheet. In order to process further sheets 11 of thick paper (or cardboard or pasteboard), by contrast, a setting of the first guide device 17, as illustrated in FIG. 7, has to be selected. Here, the small separating-shoe rollers 22 assume the maximum possible distance from the feeding table 10, so that the relatively inflexible sheets (e.g. the further sheets 11) can be fed reliably over the front lays 13 to the cylinder 12 by the guide roller 14. The guide function is therefore taken over here by the second guide device 18, which is advantageously located at a comparatively great distance from the front lays 13.

I claim:

1. A device for feeding sheets to a sheet-processing machine, comprising:

a feeding table feeding the sheets in a sheet-conveying direction and having a front end;

front lays disposed at said front end of said feeding table, as viewed in said sheet-conveying direction;

a first guide device disposed immediately upstream from said front lays, as viewed in said sheet-conveying direction, and above said feeding table, said first guide device being adjustable vertically with respect to said feeding table;

a front lay guard to be upwardly pivoted away, said first guide device being disposed on said front lay guard for pivoting about an axis oriented transversely with respect to said sheet-conveying direction; and a second guide device disposed upstream from said vertically adjustable first guide device, as viewed in said sheet-conveying direction, said second guide device being disposed in a position oriented parallel to said first guide device.

2. The sheet-feeding device according to claim 1, wherein said pivot axis of said first guide device is disposed to ensure that as a distance of said first guide device to said feeding table increases, a distance of said first guide device to said front lays simultaneously becomes greater.

3. The sheet-feeding device according to claim 1, further comprising a pneumatic cylinder disposed on said front lay guard, said pneumatic cylinder serving for vertically adjusting said first guide device.

4. The sheet-feeding device according to claim 1, further comprising a separating-shoe profile pivotably disposed on said front lay guard, said first guide device having a plurality of guide rollers oriented coaxially with one another in a row and mounted on said separating-shoe profile.

5. The sheet-feeding device according to claim 4, wherein said second guide device, in comparison with said first guide device, has at most only a few guide rollers disposed coaxially with one another in a row and at larger axial distances from one another than said guide rollers of said first guide device.

6. The sheet-feeding device according to claim 1, wherein said second guide device is also disposed, at least partly, on said front lay guard.

7. A device for feeding sheets to a sheet-processing machine, comprising:

a feeding table feeding the sheets in a sheet-conveying direction and having a front end;

front lays disposed at said front end of said feeding table, as viewed in said sheet-conveying direction;

a first guide device disposed immediately upstream from said front lays, as viewed in said sheet-conveying direction, and above said feeding table, said first guide device being adjustable vertically with respect to said feeding table;

a second guide device disposed upstream from said vertically adjustable first guide device, as viewed in said sheet-conveying direction, said second guide device being disposed in a position oriented parallel to said first guide device; and a pulling device for lateral sheet alignment, said second guide device being connected, at least partly, to said pulling device.

8. The sheet-feeding device according to claim 7, wherein said second guide device includes a central guide roller and two lateral guide rollers, said central roller being associated with said front lay guard, and said two lateral guide rollers being respectively associated with said pulling device.

9. A method of feeding sheets, which comprises:

providing a sheet-feeding device having a first guide device;

positioning the first guide device into an operating position close to a surface of a feeding table for processing a first sheet; and adjusting the first guide device into a stop position at a greater distance from the feeding table for processing further sheets following the first sheet.

10. The method of feeding sheets according to claim 9, which further comprises feeding sheets having a thickness of at least approximately 0.3 mm to at least approximately 0.6 mm.

11. A method of feeding sheets, which comprises:

providing a device for feeding sheets to a sheet-processing machine, including a feeding table, front lays disposed at a front end of the feeding table, as viewed in a sheet-conveying direction, a first guide device disposed immediately upstream from the front lays, as viewed in the sheet-conveying direction, and above the feeding table, and being adjustable vertically with respect to the feeding table, and a second guide device disposed upstream from the vertically adjustable first guide device, as viewed in the sheet-conveying direction, the second guide device being disposed in a position oriented parallel to the first guide device;

positioning the first guide device into an operating position close to a surface of the feeding table for processing a first sheet; and adjusting the first guide device into a stop position at a greater distance from the surface of the feeding table for processing further sheets following the first sheet.

* * * * *